United States Patent [19]

Johnson et al.

[11] Patent Number: 4,651,818

[45] Date of Patent: Mar. 24, 1987

[54] METAL SEAL TUBING PLUG

[75] Inventors: Dale V. Johnson, Metairie, La.; Thomas W. Childers, Høvik, Norway

[73] Assignee: Exxon Production Research Co., Houston, Tex.

[21] Appl. No.: 861,791

[22] Filed: May 12, 1986

[51] Int. Cl.[4] ..... E21B 33/128

[52] U.S. Cl. ..... 166/115; 166/140; 166/217

[58] Field of Search ..... 166/115, 117, 117.6, 166/118, 192, 140, 217

[56] References Cited

U.S. PATENT DOCUMENTS 4,178,992 12/1979 Regan et al. ..... 166/117.6

4,595,053 6/1986 Watkins et al. ..... 166/217

*Primary Examiner*—James A. Leppink

*Assistant Examiner*—Terry Lee Melius

*Attorney, Agent, or Firm*—J. S. Schneider; H. E. Cox

[57] ABSTRACT

A plug is disclosed for sealing off in a tubing having a sealing surface. A housing contains an annular metal seal means and two sets of segmented expanding lockdown rings that react with three solid rings to provide a downward motion. The expanding lockdown rings consist of a solid tapered ring that has been cut into a number of arcs. When a tapered mandrel is forced down inside the arcs, the arcs are expanded to the outside diameter of the mandrel. As the arcs expand, they are wedged between the solid rings that have matching tapers. The solid rings react between locking dogs and a shoulder in the housing to provide the downward movement. By using several expanding lockdown rings and solid rings, a relatively great deal of vertical motion can be obtained through the combined wedging action of each ring. Means on the housing and the tubing may be used to limit the locking load on the annular seal means.

3 Claims, 11 Drawing Figures

FIG. 1.
( PRIOR ART )
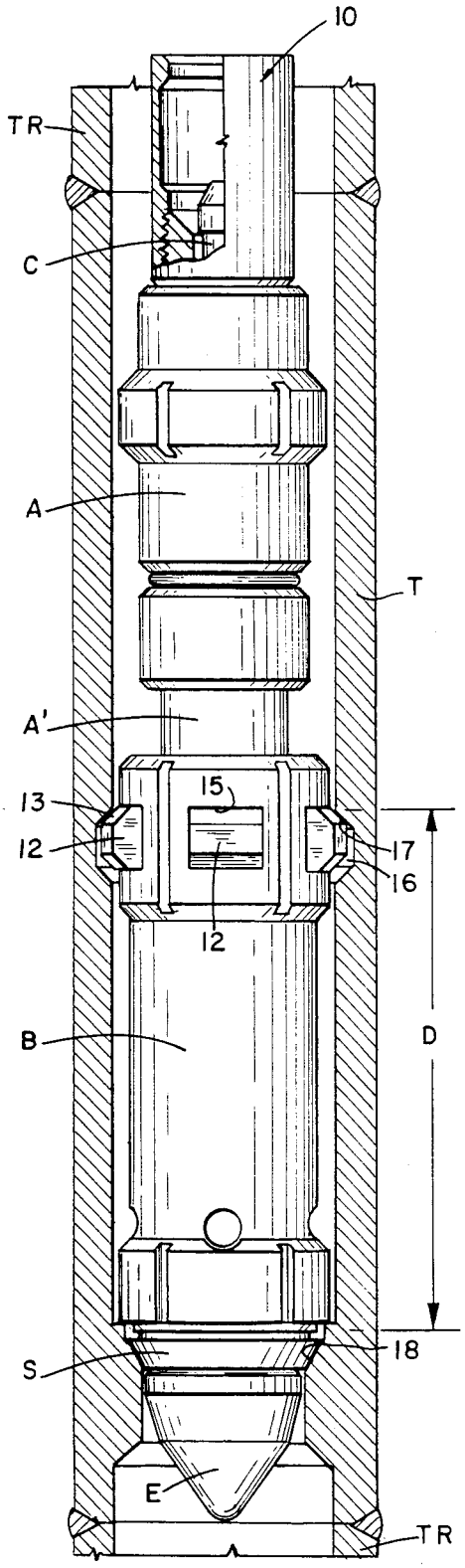
FIG. 4
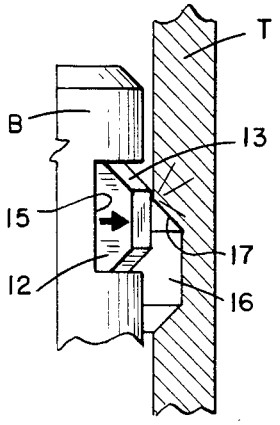
FIG. 3.
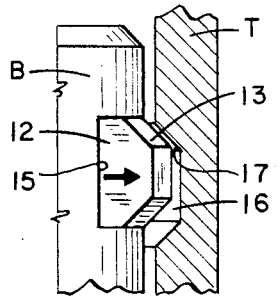
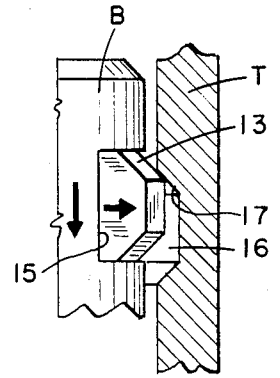
FIG. 2.
FIG. 5.
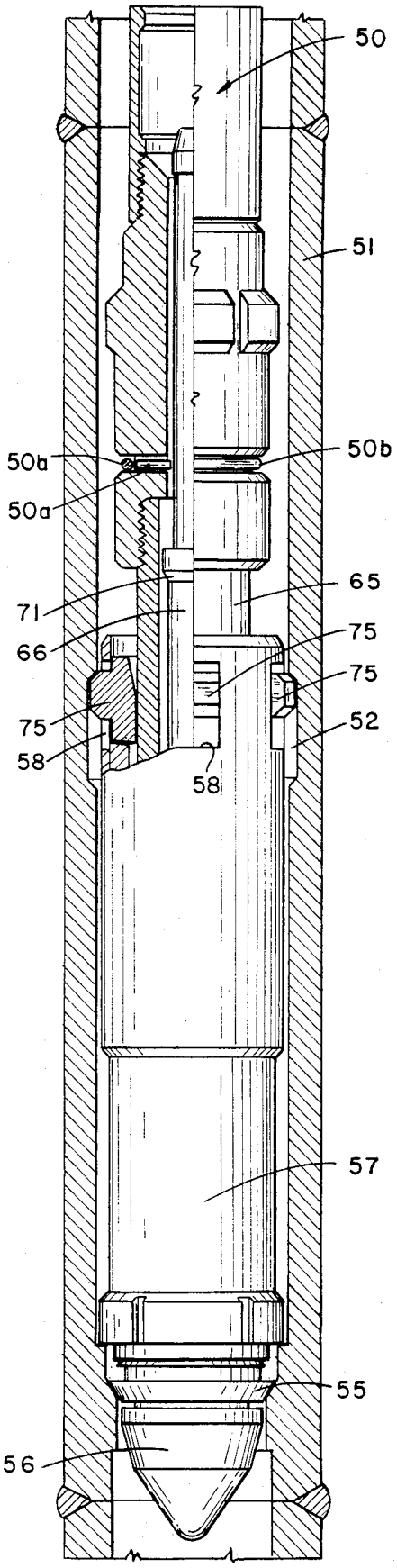

METAL SEAL TUBING PLUG

BACKGROUND OF THE INVENTION

The present invention concerns a metal seal plug and, particularly, a metal seal plug for use in sealing off a tubing run in an underwater oil and/or gas well system. It is an improvement on the metal seal tubing plug described in U.S. Pat. No. 4,178,992 which issued Dec. 18, 1979 to Louis M. Regan et al. Both plugs utilize a metal-to-metal seal which provides a reliable wire-line or tubing installable and retrievable plug for subsea tubings. A metal-to-metal type seal has superior seal reliability over conventional resilient elastomer-type seals. Materials chosen for the metal seals are less susceptible to failure and resultant leaks than available elastomer materials. Elastomer seal systems are susceptible to deterioration due to age, gas infusion, cold flow or creep.

SUMMARY OF THE INVENTION

In accordance with the teachings of the invention, a plug for use in sealing on a tapered sealing surface on a tubing run includes a housing containing an annular metal seal means. The housing also contains first and second sets of segmented tapered lockdown rings and first, second and third tapered solid rings. The first set of tapered lockdown rings is positioned between and has matching tapers with the first and second tapered solid rings. The second set of tapered lockdown rings is positioned between and has matching tapers with the second and third tapered solid rings. Each lockdown ring has an inner half cylinder bearing mounted on it. The outer tapered surface of a tapered mandrel successively contacts expansible locking dogs and each lockdown ring. A solid-rod mandrel extends through the tapered mandrel and connects to the lower end of the housing to support the tapered mandrel and prevent premature setting. Stop means on the housing and the tubing run may be provided to limit the locking load on the annular metal seal means.

BRIEF DESCRIPTION OF THE DRAWINGS

FIG. 1 illustrates the prior art tubing plug of U.S. Pat. No. 4,178,992 in its lockdown, seal position arranged in a section of a tubing run;

FIGS. 2–4 illustrate what might occur when the plug of FIG. 1 is actuated;

FIG. 5 is a partly sectional view illustrating the tubing plug of the present invention shown in lockdown, seal position;

FIG. 11 shows the upper, middle and lower solid rings.

DISCUSSION OF PRIOR ART

Figure 6:
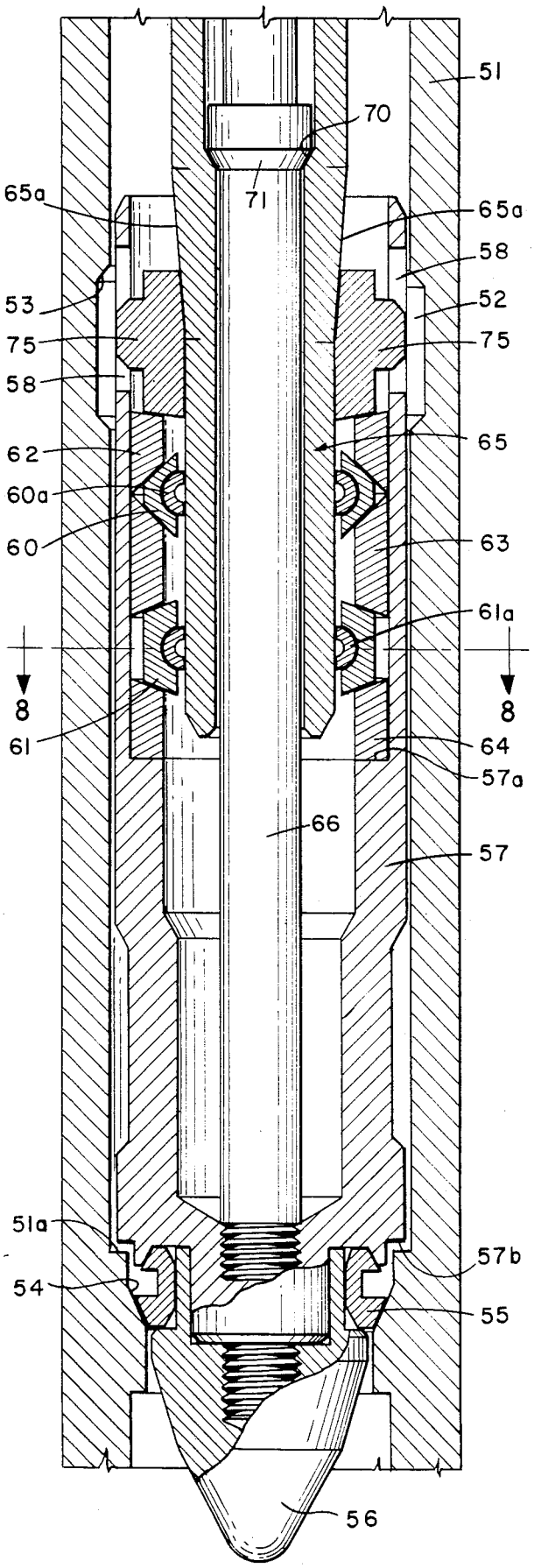
FIG. 6 is a partly sectional view of the plug of the invention arranged in a tubing in the run-in unlocked position.
Figure 7:
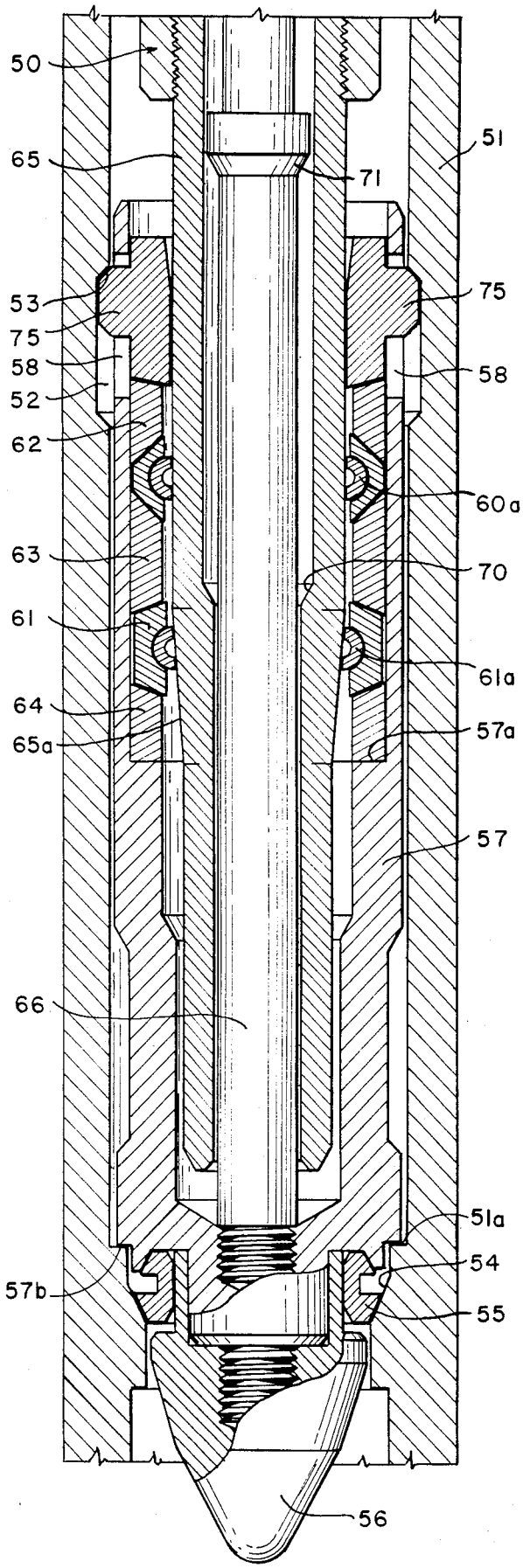
FIG. 7 is a partly sectional view of the plug of the invention in locked position.
Figure 8:
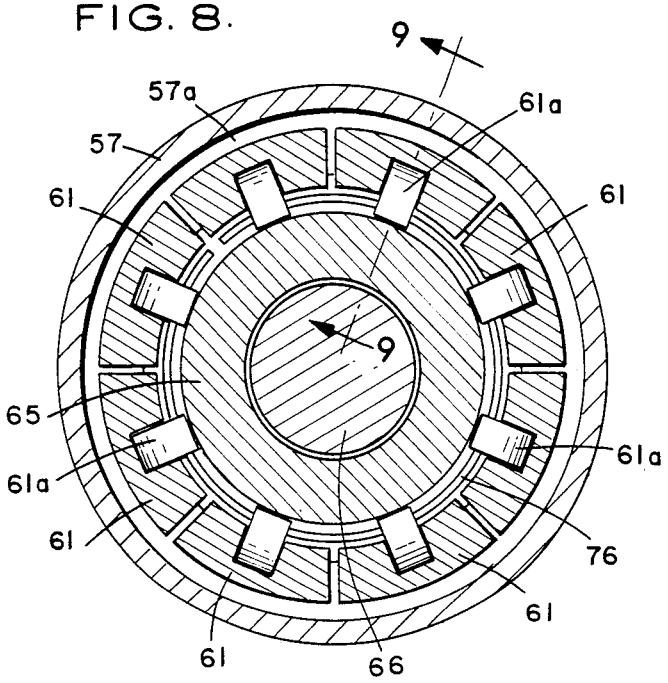
FIG. 8 is a view taken on line 8—8 of FIG. 6.

There is shown in FIGS. 1 to 4 a tubing plug assembly, generally designated 10, which includes an upper tubular housing A, a lower tubular housing B into which housing A extends, and an inner mandrel C that is threadedly attached to the lower end of housing B. Housing A is vertically movable on mandrel C. A seal ring member S is positioned between the lower end of housing B and a nose plug E that is threadedly attached to the lower end of housing B. In "running in" position on a running tool upper housing A is shear pinned to mandrel C by a shear pin and housing A is in an upper position with respect to lower housing B. The lower portion of housing A is provided wth a downwardly and inwardly extending locking taper. The upper portion of housing B is provided wth a plurality of locking dogs 12, which move laterally through windows 15 of housing B when engaged by the locking taper of upper housing A. When plug assembly 10 is run into a tubing run T and seal ring S is seated on the tapered sealing surface 18 of tubing run T, the shear pin is sheared and the running tool moves the housing portion A downwardly in housing B causing locking dogs 12 to move outwardly through windows 15 to cause locking tapers 13 of dogs 12 to engage locking taper 17 of locking recess 16.

If locking taper 17 is correctly spaced above sealing surface 18 a distance "D", tapered surfaces 13 of dogs 12 properly engage locking surface 17, as indicated by the arrows in FIG. 2, and housing B is moved downwardly to apply the proper sealing pressure between seal ring S and tapered sealing surface 18.

In FIG. 3, taper 17 of recess 16 is spaced too high and locking taper 13 of dogs 12 cannot engage 17 to cause downward movement of, and to exert downward pressure on, housing B.

In FIG. 4, taper 17 is spaced too low for locking dogs 12 to enter recess 16.

As locking dogs 12 are confined to lateral movement through windows 15, the spacing of the locking taper is critical. The spacing or distances between surfaces 17 and 18 of tubing run T are precisely selected so that seal ring S is properly loaded for sealing purposes against taper 18 when plug 10 is locked in its actuated position.

Thus, if locking taper 13 of dogs 12 is 0.250 inches deep and the taper angle is 45°, then 0.250 inches of vertical travel is available for gasket makeup. The downward motion is caused by the taper on the locking dogs being forced by the taper of the upper housing portion into and down the taper 17 of tubing section T. Approximately 0.125 inches is required for the seal ring S itself. The remaining 0.125 inches must not be taken up by manufacturing tolerance stackups or enough movement will not be available to properly energize seal ring S.

DESCRIPTION OF THE PREFERRED EMBODIMENT

Referring now to FIGS. 5 through 11, there is shown a tubing plug, generally designated 50, arranged in a tubing run or section 51. A locking recess 52 is formed on the inner surface of tubing 51. Recess 52 has a tapered surface 53 at its upper end. Tubing 51 also has a tapered sealing surface 54 for engaging an annular crescent-shaped metal seal member 55 arranged between a cone-shaped end member 56 and a U-shaped housing 57. A shoulder **57*b* formed on the lower outer surface of housing 57 above seal member 55 engages a ledge 51*a* formed on the inner surface of tubing section 51**.

There is a potential problem of over yielding seal member 55 if it must absorb all of the locking load. By having housing 57 shoulder out on ledge **51*a*, seal member 55 is only partially energized and the rest of the load is put into the contact of housing 57 and tubing section 51. The preloaded contact between housing 57 and tubing section 51 also eliminates any relative movement between seal member 55 and sealing surface 54. Although the ledge and shoulder are included in FIG. 1** as prior art, that feature of the tubing plug is not part of the prior art.

In FIG. 5, a shear pin 50*a* has been sheared from connection to solid rod mandrel 66. The sheared portion of the plug is retained in the plug housing by an O-ring 50*b*.

Supported on an annular shoulder 57*a* formed on the inner wall of housing 57 are upper and lower sets of segmented lockdown rings 60 and 61, respectively, positioned between upper, middle, and lower solid rings 62, 63, and 64, respectively. Each segment of lockdown rings 60 and 61 has a half-cylinder bearing 60*a* and 61*a*, respectively, that contacts a mandrel 65 extending into housing 57. The outer surface of mandrel 65 has a tapered section 65*a*. The surfaces on the upper set of lockdown rings 60 have a 45° taper. The surfaces on the lower set of lockdown rings 61 have a 20° taper. The taper 65*a* on mandrel 65 is 4°.

Solid rod mandrel 66 extends through tapered mandrel 65 and threads into the lower end of housing 57. In the unlocked position of mandrel 65, a shoulder 70 formed on the inner surface of tapered mandrel 65 engages a shoulder 71 formed on rod mandrel 66. A series of locking dogs 75 surround tapered mandrel 65 above the upper solid ring 62.

Figure 10:
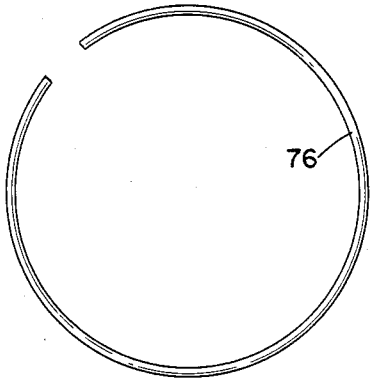
FIG. 10 is a top view of the split ring shown in FIG. 9.
Figure 10:
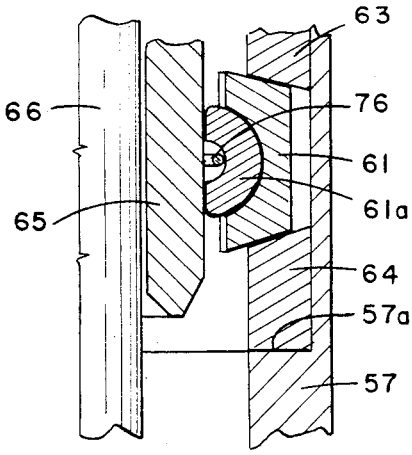
Figure 9:
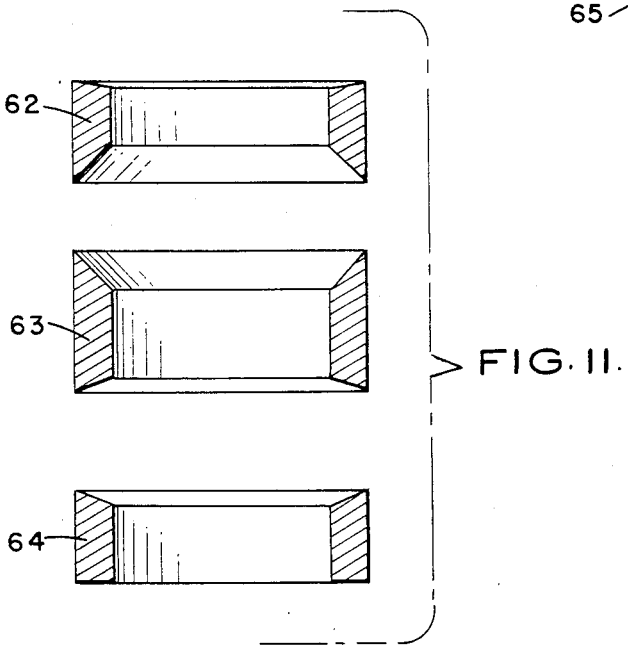
FIG. 9 is a view taken on line 9—9 of FIG. 8.

As seen in FIGS. 9 and 10, a split ring 76 is positioned within each of the half-cylinder bearings 60*a* and 61*a*.

The two sets of segmented expanding lock rings 60 and 61 react with the three solid rings 62, 63, and 64 to provide a downward motion of, for example, 0.375 inches. This is achieved wth a locking recess taper depth of only 0.156 inches. Thus, a smaller OD tube can be used while gaining greater vertical makeup travel.

The expanding lockdown rings 60 and 61, consist of solid tapered rings that have been cut into several arcs. When tapered mandrel 65 is forced down inside the arcs, the arcs are expanded to the outside diameter of tapered mandrel 65. As these arcs expand, they are wedged between the solid rings 62, 63 and 64 that have matching tapers. The solid rings react between the locking dogs 75 and the annular shoulder 57*a* in the housing to provide the downward movement.

By using several expanding lockdown rings and solid rings, a relatively great deal of vertical motion can be obtained through the combined wedging action of each ring.

To set plug 50, mandrel 65 is driven down. As the mandrel moves down, the 4° taper on it forces locking dogs 75 outwardly. These locking dogs now "fall" into a relatively wide locking recess tapered groove. The locking dog/locking recess taper engagement is not relied on to energize the gasket. As tapered mandrel 65 continues downward movement, the first set of segmented lockdown rings 60 are contacted and expanded. Lockdown ring 60 has a 45° taper so that when it is expanded, a relatively large amount of wedging motion occurs. Such action takes up the "slop" between the locking dogs and their locking taper 53 of tubing 51, but does not energize gasket 55.

The half-cylinder bearing 60*a* is free to rotate in the pockets on the lockdown ring. This allows the inside surface of the bearing to remain flush with the mandrel, even on the 4° tapered section of mandrel 66, and insures that the outward forces generated by the mandrel's wedging action will always act through the center of the lockdown rings and will not cock them. Additionally, this prevents a sharp edge from cutting into and stopping the mandrel and it provides a broader area to distribute the forces.

The space-out of the mandrel taper and the solid rings and lockdown rings is such that the upper set of lockdown rings 60 will not be contacted by the mandrel taper until the locking dogs 75 are fully expanded on the large OD of the mandrel. Similarly, the lower set of lockdown rings 61 will not be expanded until the upper set 60 is fully out.

After the upper set of lockdown rings 60 are expanded, tapered mandrel 65 continues downward movement and begins to expand the lower set of lockdown rings 61. This set has a 20° taper. It provides enough movement to energize the gasket. The shallow taper allows much force to be directed into the gasket since little actual motion is required.

Once the required load is placed into the gasket, the 4° taper on the mandrel is sufficient to ensure that the mandrel cannot be forced back up by forces from below. Only when the mandrel is pulled up from above are the lockdown rings and locking dogs free to fall back and allow plug removal.

Any number of lockdown rings and solid rings may be employed to give an almost unlimited amount of travel to be achieved. The only drawback to the use of additional sets of rings is that the overall tool length may become excessive.

Various modifications of the invention described may be made without departing from the scope of the invention as defined in the appended claims.

We claim:

1. A plug for use in sealing a tubing having a locking recess and a tapered sealing surface formed on the inner wall thereof, said recess having a tapered surface comprising:

a housing containing an annular metal seal means;

a mandrel having a tapered outer surface arranged in said housing;

first and second sets of segmented, tapered lockdown rings arranged in said housing;

first set of segmented, second and third tapered solid rings arranged in said housing; said first tapered lockdown rings being positioned between and having matching tapers with first and second set of segmented tapered solid rings; said second tapered lockdown rings being positioned between and having matching tapers with said second and third tapered solid rings;

each lockdown ring having an inner half-cylinder bearing contacting said tapered mandrel and connected to said housing surface; and an inner solid rod mandrel extending through said tapered mandrel.

2. A plug as recited in claim 1 in which said annular metal seal means comprises a first tapered sealing surface for sealing against a sealing surface on said housing and a second sealing surface for sealing against said sealing surface on said tubing.

3. A plug as recited in claim 1 including a ledge formed on said housing above said seal means and a shoulder formed on said tubing, said ledge engaging said shoulder to limit the locking load on said seal means.

* * * * *